US008442420B2

(12) United States Patent
Shimazu

(10) Patent No.: US 8,442,420 B2
(45) Date of Patent: May 14, 2013

(54) INTERMEDIATE TRANSFER BELT AND ELECTRO-PHOTOGRAPHIC IMAGE FORMING APPARATUS WITH INTERMEDIATE TRANSFER BELT

(75) Inventor: Fumio Shimazu, Hachioji (JP)

(73) Assignees: Casio Electronics Manufacturing Co., Ltd, Saitama (JP); Casio Computer Co., Ltd., Tokyo (JP)

( * ) Notice: Subject to any disclaimer, the term of this patent is extended or adjusted under 35 U.S.C. 154(b) by 344 days.

(21) Appl. No.: 12/834,918

(22) Filed: Jul. 13, 2010

(65) Prior Publication Data

US 2011/0013952 A1 Jan. 20, 2011

(30) Foreign Application Priority Data

Jul. 14, 2009 (JP) ..... 2009-165223
Feb. 25, 2010 (JP) ..... 2010-039860

(51) Int. Cl.
*G03G 15/01* (2006.01)
*G03G 15/20* (2006.01)

(52) U.S. Cl.
USPC ..... 399/302; 399/308

(58) Field of Classification Search ..... 399/302, 399/308, 313
See application file for complete search history.

(56) References Cited

U.S. PATENT DOCUMENTS

| | | | | |
|---|---|---|---|---|
| 6,133,927 | A * | 10/2000 | Arai et al. | 399/302 X |
| 6,463,248 | B1 * | 10/2002 | Jia et al. | 399/302 |
| 6,834,176 | B2 * | 12/2004 | Saito et al. | 399/302 |
| 8,064,812 | B2 * | 11/2011 | Meade et al. | 399/302 |
| 2005/0069351 | A1 * | 3/2005 | Matsuo et al. | 399/286 |
| 2008/0166159 | A1 * | 7/2008 | Watanabe et al. | 399/302 |
| 2010/0300604 | A1 * | 12/2010 | Goss et al. | 156/154 |

FOREIGN PATENT DOCUMENTS

| | | | |
|---|---|---|---|
| JP | 04-303870 | * | 10/1992 |
| JP | 11-095567 | A | 4/1999 |
| JP | 2004-094037 | A | 3/2004 |
| JP | 2005-010692 | A | 1/2005 |
| JP | 2009-047857 | A | 3/2009 |

* cited by examiner

*Primary Examiner* — Sandra Brase
(74) *Attorney, Agent, or Firm* — Holtz, Holtz, Goodman & Chick, P.C.

(57) ABSTRACT

An intermediate transfer belt is built in an electro-photographic image forming apparatus. A toner image formed on a photosensitive element is primary transferred on the intermediate transfer belt. The intermediate transfer belt secondary transfers the primary transferred toner image on a recording medium being conveyed at a secondary transfer unit. The intermediate transfer belt has streaks formed by surface roughening on the surface thereof and directed so as to have an angle relative to the driving direction of the intermediate transfer belt within a range from 40 to 140 degree. This angle setting enables stable transfer of an image without causing any character missing.

2 Claims, 15 Drawing Sheets

| AVERAGE | BELT A | BELT B | BELT C | BELT D | BELT E |
|---|---|---|---|---|---|
| Ra | **0.03275** | **0.06125** | **0.0835** | **0.11225** | **0.150333** |
| Ry | 0.3375 | 0.7 | 0.875 | 1.5825 | 1.94 |
| Rz | 0.167 | 0.518 | 0.626 | 1.149 | 1.590667 |
| RMS | 0.04125 | 0.07725 | 0.105 | 0.14275 | 0.194 |

FIG. 9A

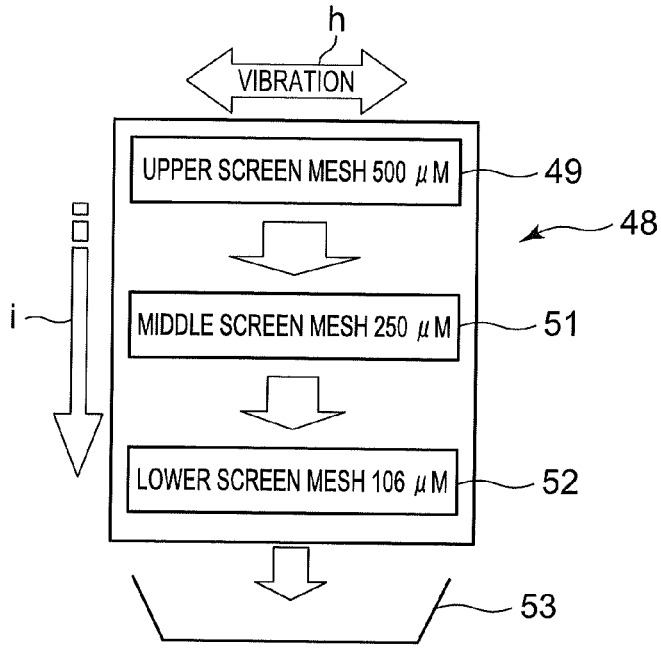

FIG. 9B

| | UPPER SCREEN | MIDDLE SCREEN | LOWER SCREEN | TRAY |
|---|---|---|---|---|
| TONER AMOUNT g | 0.4 | 0.81 | 1.81 | 1.99 |
| COEFFICIENT | 0.40 | 1.00 | 1.70 | 2.00 |
| FLOWABILITY | 0.16 | 0.81 | 3.077 | 3.98 |

FLOWABILITY INDEX = (UPPER SCREEN FLOW VALUE + MIDDLE SCREEN FLOW VALUE + LOWER SCREEN FLOW VALUE) 8.03

FIG. 9C

| | UPPER SCREEN | MIDDLE SCREEN | LOWER SCREEN | TRAY |
|---|---|---|---|---|
| TONER AMOUNT g | 3.45 | 1.13 | 0.3 | 0.12 |
| COEFFICIENT | 0.40 | 1.00 | 1.70 | 2.00 |
| FLOWABILITY | 1.38 | 1.13 | 0.51 | 0.24 |

FLOWABILITY INDEX = (UPPER SCREEN FLOW VALUE + MIDDLE SCREEN FLOW VALUE + LOWER SCREEN FLOW VALUE) 3.26

FIG. 9D

| | UPPER SCREEN | MIDDLE SCREEN | LOWER SCREEN | TRAY |
|---|---|---|---|---|
| TONER AMOUNT g | 1.01 | 1.23 | 1.42 | 1.34 |
| COEFFICIENT | 0.40 | 1.00 | 1.70 | 2.00 |
| FLOWABILITY | 0.404 | 1.23 | 2.414 | 2.68 |

FLOWABILITY INDEX = (UPPER SCREEN FLOW VALUE + MIDDLE SCREEN FLOW VALUE + LOWER SCREEN FLOW VALUE) 6.73

FIG. 10

| AVERAGE | BELT A | BELT B | BELT C | BELT D | BELT E |
|---|---|---|---|---|---|
| TONER A | ● | ○ | ◎ | ◎ | ◎ |
| TONER B | × | △ | ● | ○ | ◎ |
| TONER C | × | △ | ○ | ◎ | ◎ |

FIG. 11A
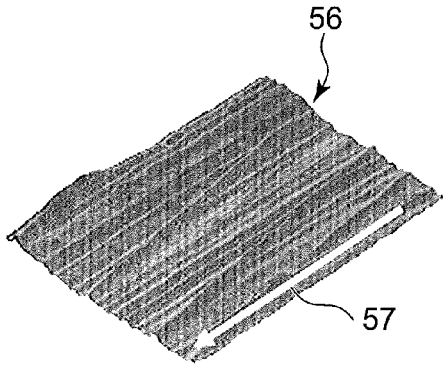
FIG. 11B
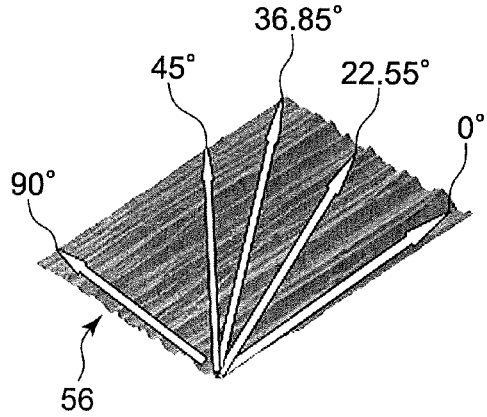
FIG. 11C
| | 0 | 22.55 | 36.85 | 45 | 90 |
|---|---|---|---|---|---|
| Ra | 0.032 | 0.103 | 0.113 | 0.116 | 0.102 |
| Ry | 0.210 | 0.657 | 0.727 | 0.758 | 0.781 |
| Rz | 0.137 | 0.417 | 0.548 | 0.551 | 0.554 |
| RMS | 0.040 | 0.131 | 0.144 | 0.146 | 0.133 |
FIG. 11D
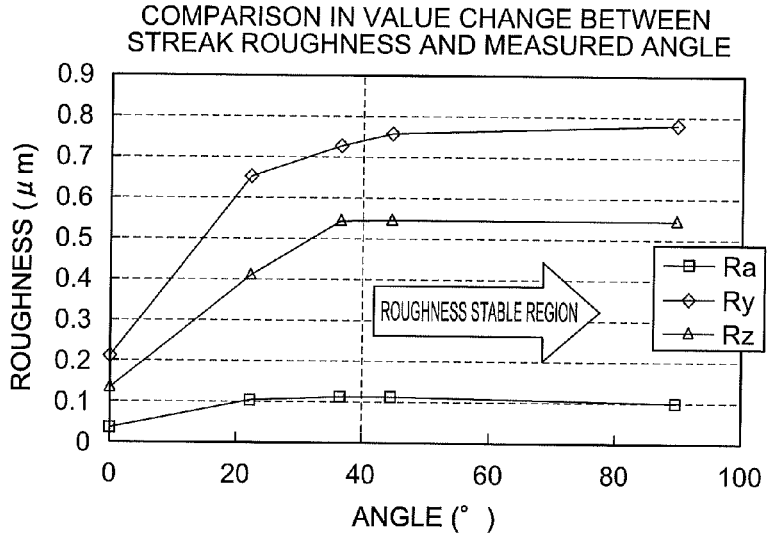

INTERMEDIATE TRANSFER BELT AND ELECTRO-PHOTOGRAPHIC IMAGE FORMING APPARATUS WITH INTERMEDIATE TRANSFER BELT

CROSS-REFERENCE TO RELATED APPLICATION

This application claims the benefit of Japanese Patent Application No. 2009-165223, filed on Jul. 14, 2009, and Japanese Patent Application No. 2010-039860, filed on Feb. 25, 2010, the entire disclosure of which is incorporated by reference herein.

FIELD

This application relates generally to an intermediate transfer belt built in an electro-photographic image forming apparatus, and more particularly, to an intermediate transfer belt which does not cause any so-called "character missing".

BACKGROUND

Conventionally, general electro-photographic image forming apparatus cause a photosensitive drum to be charged uniformly to initialize it, and form an electrostatic latent image on the photosensitive drum by optical writing. The electrostatic latent image is caused to be a toner image, and the toner image is directly or indirectly transferred on a transfer material like paper, and is fixed by a fixing device.

For such charging and transferring, corona discharging electrifiers and transfer devices were popularly used. However, because of the issue of deterioration of a use environment originating from generation of ozone, contact-type electrifiers and transfer devices are often used recently. For example, roller-type transfer devices are often used as the contact-type transfer devices.

In direct transferring, the roller-type transfer devices contact the rear face of a conveyance belt which contacts a peripheral face of a photosensitive drum to convey paper, and apply a transfer voltage to the conveyance belt, thereby transferring a toner image on the peripheral face of the photosensitive drum onto the paper.

Moreover, in recent days, for example, as is disclosed in Unexamined Japanese Patent Application KOKAI Publication No. H11-095567, indirect-transfer type image forming apparatus using an intermediate transfer belt is widely used. According to the indirect transfer scheme, first, a toner image on the peripheral face of a photosensitive drum is primary transferred on the intermediate transfer belt, and is secondary transferred on paper from the intermediate transfer belt.

According to the scheme using such intermediate transfer belt, when a strip-shaped long and thin image parallel to the driving direction of the intermediate transfer belt is primary transferred, a phenomenon in which merely the middle portion of the long and thin image is not transferred and remains at the photosensitive drum side frequently happens.

That is, a failure which is so-called "character missing" that the center portion of the long and thin image is missing and only portions by what corresponds to two parallel lines are transferred occurs. Moreover, failures which happen at the time of primary transfer include transfer dust, transfer failure, and an image defect like a whitened dot.

An image forming apparatus disclosed in Unexamined Japanese Patent Application KOKAI Publication No. 2005-10692 employs a structure of moving a toner toward an intermediate transfer body side across a contact part between an image support body and the intermediate transfer body, and the image support body comprises an electro-photographic photosensitive element having a photosensitive element layer and a surface passivation layer stacked on a conductive basal body in this order. This patent literature also discloses that the surface passivation layer of the electro-photographic photosensitive element is formed of a radiation cross-linking agent and of an electrical charge transporting material, and is subjected to radiation cross-linking, thereby improving or eliminating failures including transfer dust, transfer failure, etc.

Unexamined Japanese Patent Application KOKAI Publication No. 2004-94037 discloses an image forming apparatus which can surely suppress any image defects like a whitened dot. This image forming apparatus uses a transfer roller or a transfer belt having a specific insulating layer formed on the outermost layer, and is equipped with neutralization means for eliminating electrical charges accumulated on the transfer belt when using the transfer belt.

Furthermore, Unexamined Japanese Patent Application KOKAI Publication No. 2009-47857 discloses an image forming apparatus for the purpose of suppressing any image defects in a primary-transferred toner image from an electrostatic latent image support body on an intermediate transfer body without deteriorating a secondary transfer efficiency. This image forming apparatus has an endless belt of the intermediate transfer body employing a stacked-layer structure of at least two layers, and the belt outermost surface layer has hardness higher than that of an elastic layer which is a lower layer, and the outermost surface layer is divided into plural pieces.

According to the technologies disclosed in the foregoing Unexamined Japanese Patent Application KOKAI Publication No. 2005-10692 and Unexamined Japanese Patent Application KOKAI Publication No. 2004-94037, transfer dust, transfer failure and an image defect like a whitened dot are surely improved, so that such technologies may be able to cope with character missing if devised in some measure. However, both of those technologies have a premise that a special processing is performed on a photosensitive element, so that production thereof is difficult, resulting in advance of prices.

Moreover, a technology disclosed in Unexamined Japanese Patent Application KOKAI Publication No. 2009-47857 requires a highly-advanced and difficult technology in production of an endless belt such that the endless belt of an intermediate transfer body employs not only a stacked-layer structure but also a structure in which a surface layer has hardness higher than that of a lower layer and the outermost surface layer is divided into plural pieces. This brings about advance of prices.

It is thought that a character missing occurred in a strip-shaped long and thin image originates from pressure applied to a toner, and a technology of using a lubricate like stearic acid in order to make the motion of toner at the time of transferring smooth is proposed. The fact is, however, there is no image forming apparatus which can overcome a character missing with a simple structure so far.

SUMMARY

The present invention has been made in view of the foregoing circumstances, and it is an object of the present invention to provide an intermediate transfer belt which is used for an electro-photographic image forming apparatus that can perform stable transferring without causing any character missing.

To achieve the object, an intermediate transfer belt according to a first aspect of the present invention is built in an electro-photographic image forming apparatus, a toner image formed on a photosensitive element is primary transferred on the intermediate transfer belt, and the intermediate transfer belt secondary transfers, at a secondary transfer unit, the primary-transferred toner image on a recording medium being conveyed, wherein a direction of a streak formed by surface roughening on a surface of the intermediate transfer belt is set to have an angle relative to a driving direction of the intermediate transfer belt within a range from 40 to 140 degree.

To achieve the object, an electro-photographic image forming apparatus according to a second aspect of the present invention at least comprises: a photosensitive element; a toner image forming unit that forms a toner image on the photosensitive element; and an intermediate transfer belt on which the toner image formed on the photosensitive element is primary transferred, and which secondary transfers, at a secondary transfer unit, the primary transferred tone image on a recording medium being conveyed, wherein the intermediate transfer belt has a streak formed by surface roughening on the surface of the intermediate transfer belt and directed so as to have an angle relative to a driving direction of the intermediate transfer belt within a range from 40 to 140 degree.

According to the intermediate transfer belt of the present invention, plural streaks with different angles within a range from 40 to 140 degree may coexist. Moreover, it is preferable that roughness of the belt surface should be $Ra \geqq 0.05$ μm and $Rz \geqq 0.5$ μm.

As the rough surface of the intermediate transfer belt is caused to have streaks formed by a streak forming technique which is simple surface roughening and directed so as to have an angle relative to the driving direction of the intermediate transfer belt within a range from 40 to 140 degree and to have the foregoing belt surface roughness, it becomes possible to provide an intermediate transfer belt which can not only acquire a good image with high stability against character missing but also have stable cleaning characteristic, thus having high mass-productivity and being inexpensive.

BRIEF DESCRIPTION OF THE DRAWINGS

A more complete understanding of this application can be obtained when the following detailed description is considered in conjunction with the following drawings, in which:

FIG. 9A is an exemplary diagram showing a three-stage-screen vibrating/falling test which is a scheme of a flowability test of toner;

FIG. 9B to 9D are diagrams showing a result acquired from the three-stage-screen vibrating/falling test of toners of three kinds, and flowability indexes thereof;

FIG. 10 is a diagram showing evaluations for character missing in combinations of belts A, B, C, D, and E with toners A, B, and C in a primary transfer test;

FIG. 11A is a diagram showing a case in which the streaks of surface roughness are parallel to the driving direction of an intermediate transfer belt;

FIG. 11B is a diagram showing a measured angle of linear roughness relative to the streaks of surface roughness;

FIG. 11C is a table showing a measurement result in FIG. 11B;

FIG. 11D is a graph of values shown in FIG. 11C;

DETAILED DESCRIPTION

An embodiment of the present invention will be explained below in detail with reference to the accompanying drawings.

Figure 1:
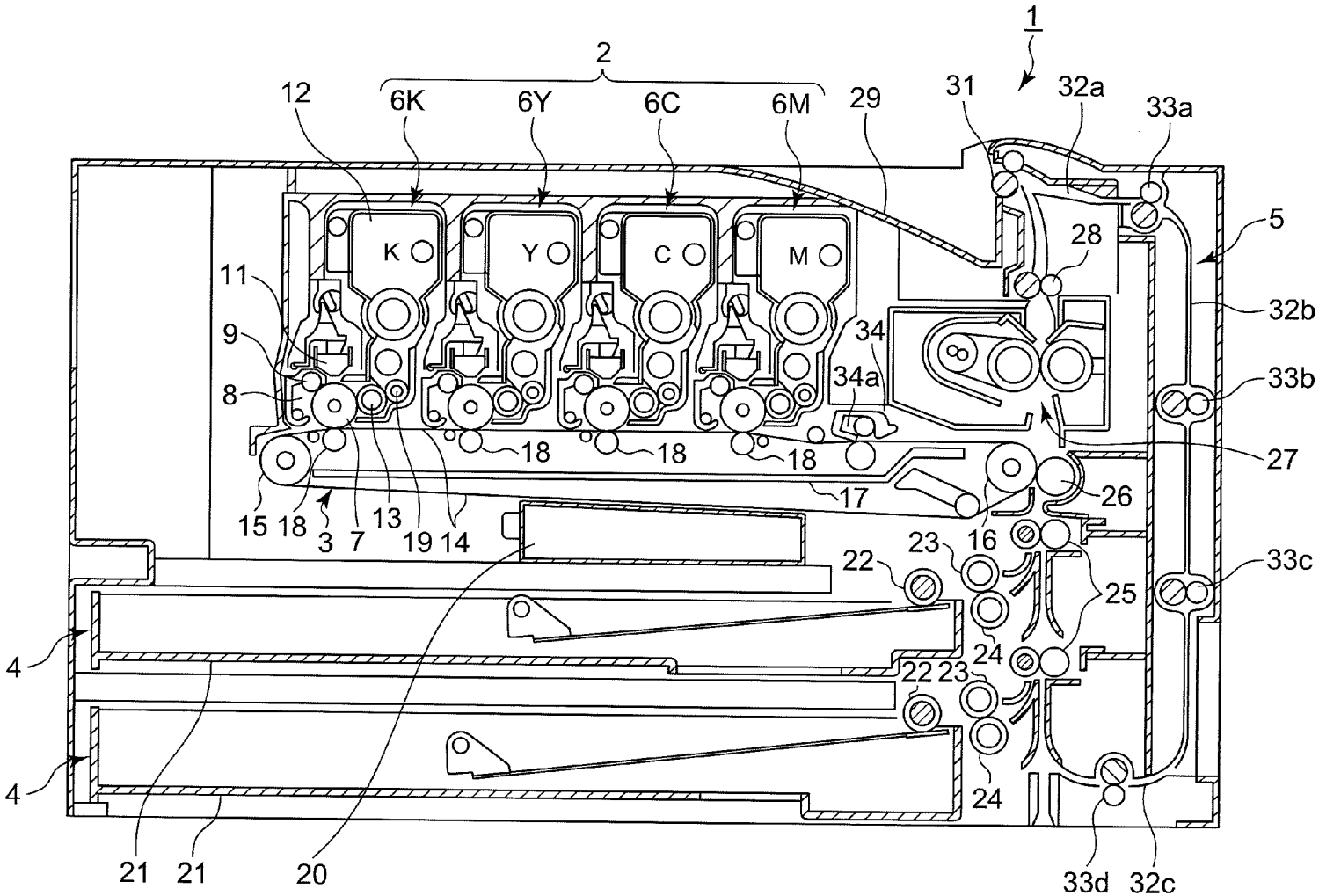
FIG. 1 is a cross-sectional view for explaining an internal structure of a full-color image forming apparatus (printer) according to an embodiment of the present invention.

FIG. 1 is a cross-sectional view for explaining an internal structure of a full-color image forming apparatus (hereinafter, simply-called a printer) according to an embodiment of the present invention. A printer 1 shown in FIG. 1 is a tandem color image forming apparatus which is an electro-photographic type and which adopts a secondary transfer scheme. The printer 1 comprises an image forming section 2, an intermediate transfer belt unit 3, paper feeder 4, and both-face printing conveyance unit 5.

The image forming section 2 comprises four image forming units 6 (6M, 6C, 6Y, and 6K) arranged side by side from right to left of the figure in a multi-staged manner.

The three image forming units 6M, 6C, and 6Y at the upstream side (right side in the figure) among the four image forming units 6 form mono-color images by color toners with magenta (M), cyan (C), and yellow (Y), respectively, which are three primary colors of subtractive color mixing. The image forming unit 6K forms a black-and-white image by a black (K) toner mainly used for a dark part, etc., of a character or an image.

Individual image forming units 6 have the common structure except the color of toner retained in a tonner container (tonner cartridge). Accordingly, the explanation below will be given of the structure of the black (K) image forming unit 6K as a typical example.

The image forming unit 6 has a photosensitive drum 7 provided at the lowermost part. The photosensitive drum 7 has a peripheral face formed of, for example, an organic photoconductive material. A cleaner 8, an electrifying roller 9, an optical writing head 11, and a developing roller 13 of a developing machine 12 are provided around the peripheral face of the photosensitive drum 7.

The developing machine 12 retains, in the toner container located above the developing machine 12, a developing agent (toner) of any one color of magenta (M), cyan (C), yellow (Y), and black (K) which are indicated by symbols M, C, Y, and K in FIG. 1, respectively. The developing machine 12 has a toner supply mechanism provided at the middle part to supply toner to the lower part.

Moreover, the developing machine 12 has the developing roller 13 provided at a side opening at the lower part, and includes a toner stirring member, a toner supply roller for supplying toner to the developing roller 13, and a doctor blade which regulates the thickness of a toner layer on the developing roller 13 to be a certain thickness, all arranged inside the developing machine 12.

The intermediate transfer belt unit 3 includes an endless intermediate transfer belt 14 extending from a right end to a left end in the figure at the substantial center of the main device as a flat loop, and a belt driving roller 15 and a driven roller 16 on which the intermediate transfer belt 14 is suspended. The belt driving roller 15 and the driven roller 16 circulatingly move the intermediate belt 14 in the counter-clockwise direction in the figure.

The intermediate transfer belt 14 is conveyed to a transfer position so as to transfer (primary transfer) a toner image directly on a belt face, and to further transfer (secondary transfer) the toner image on a recording medium (called paper in some cases), so that the whole unit is called the intermediate transfer belt unit in the present embodiment.

The intermediate transfer belt unit 3 has a belt position control mechanism 17 provided inwardly of the flat-loop intermediate transfer belt 14. The belt position control mechanism 17 has primary transfer rollers 18 each formed of a conductive foamed sponge pressed against the lower peripheral face of the photosensitive drum 7 via the intermediate transfer belt 14.

The belt position control mechanism 17 rotates and moves three primary rollers 18 corresponding to the three image forming units 6M, 6C, and 6Y of magenta (M), cyan (C), and yellow (Y) at the same cycle around respective hook-like support shafts.

The belt position control mechanism 17 also rotates and moves the one primary transfer roller 18 corresponding to the black (K) image forming unit 6K at a rotation/motion cycle different from the common cycle of the three primary transfer rollers 18 to move the intermediate transfer belt 14 apart from the photosensitive drum 7.

That is, the belt position control mechanism 17 can adjust the position of the intermediate transfer belt 14 of the intermediate transfer belt unit 3 to a full-color mode (a position where all four primary transfer rollers 18 abut the intermediate transfer belt 14), a white-and-black mode (a position where only the primary transfer roller 18 corresponding to the image forming unit 6K abuts the intermediate transfer belt 14), and a complete non-transfer mode (a position where all four primary transfer rollers 18 move apart from the intermediate transfer belt 14).

The intermediate transfer belt unit 3 has a belt cleaning unit 34 provided at a further upstream side of the image forming unit 6M at the outermost upstream side of the belt-upper-face moving direction. Moreover, a disposal toner collecting container 20 is provided which is flat and thin along the whole lower face of the belt and which is freely attachable/detachable relative to the lower face of the belt.

The paper feeder 4 has two paper feeding cassettes 21 arranged in the vertical direction in a two-tiered manner, and paper pickup roller 22, a paper feeding roller 23, a handling roller 24, and a stand-by conveyance roller pair 25 are arranged in the vicinity of each paper feeding opening (right part in the figure) of the paper feeding cassette 21.

Arranged in the paper conveyance direction of the stand-by conveyance roller pair 25 is secondary transfer roller 26 which press-contacts against the driven roller 16 via the intermediate transfer belt 14, and the driven roller 16 and the secondary transfer roller 26 configure a secondary transfer part for paper.

A belt-type fixing device 27 is arranged at the downstream side (upper side in the figure) of the secondary transfer part. Arranged at further downstream side of the belt-type fixing device 27 are a carry-out roller pair 28 which carries out paper having undergone fixing from the belt-type fixing device 27, and a paper ejecting roller pair 31 which ejects carried out paper to an ejected paper tray 29 provided on the upper face of the device.

The both-face printing conveyance unit 5 includes a start return path 32*a* divided in a right transverse direction in the drawing from a conveyance path of the middle part between the carry-out roller pair 28 and the paper ejecting roller pair 31, a middle return path 32*b* turned downwardly from the start return path 32*a*, an end return path 32*c* which is turned in a left transverse direction to eventually make return paper upside down, and four return roller pairs 33*a*, 33*b*, 33*c*, and 33*d* provided at respective halfway of those return paths.

The exit of the end return path 32*c* is communicated with a conveyance path to the stand-by conveyance roller pair 25 corresponding to the lower paper feeding cassette 21 of the paper feeder 4. Moreover, the belt cleaning unit 34 is arranged on the upper face of the intermediate transfer belt unit 3 in the present embodiment.

The belt cleaning unit 34 rubs off and eliminates disposal toner by a belt cleaner blade 34*a* which abuts the upper face of the intermediate transfer belt 14, accumulates the disposal toner in a temporary reservoir of a belt cleaner unit which is not illustrated, and conveys the accumulated disposal toner to an upper part inside a fall tube by a conveyance screw, thereby feeding the disposal toner in the disposal toner collecting container 20 through the fall tube.

As shown in FIG. 1, the printer 1 adopts not a scheme of directly transferring a toner image on paper, but a scheme of transferring a toner image on paper conveyed by the stand-by conveyance roller pair 25 in the vertical direction to the secondary transfer part through the intermediate transfer belt 14.

Figure 2:
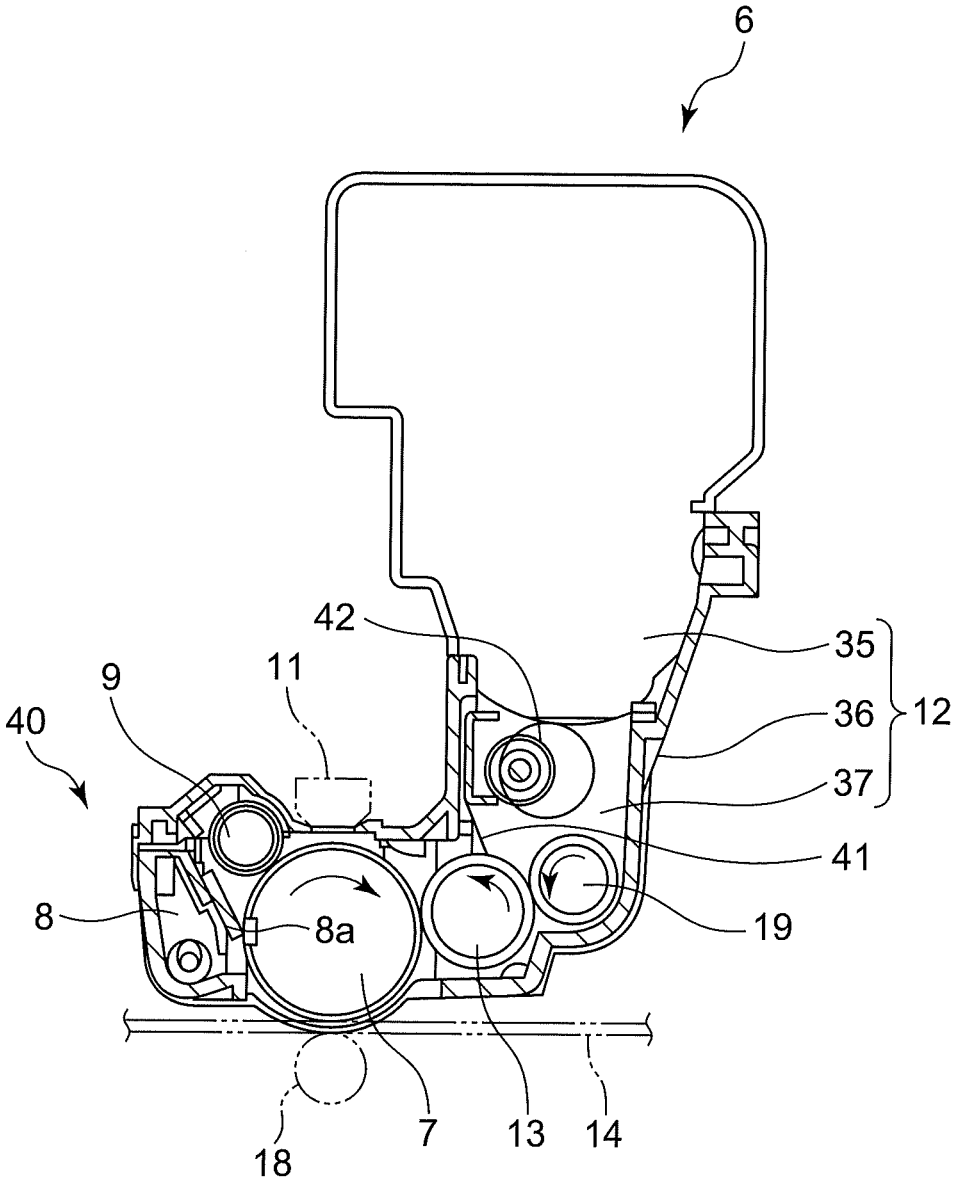
FIG. 2 is a cross-sectional view showing an image forming unit of the printer according to the embodiment of the present invention.

FIG. 2 is a cross-sectional view showing the image forming unit 6. Note that the same structural element in FIG. 2 as that of FIG. 1 is denoted by the same reference numeral. The optical writing head 11, the intermediate transfer belt 14, and the primary transfer roller 18 all engaging with the image forming unit 6 when the image forming unit 6 is attached to the main device are indicated by two-dot chain lines.

As shown in FIG. 2, the image forming unit 6 comprises a toner cartridge 35, the developing machine 12 having an exterior frame 36, and a drum unit 40 assembled with the exterior frame 36 and becoming integrated together with the developing machine 12.

Built in the drum unit 40 are the photosensitive drum 7, the cleaner 8, the electrifying roller 9, etc. The developing machine 12 has a developing unit 37 where a supply roller 19, the developing roller 13, a doctor blade 41, and a stirrer 42 are arranged.

The cleaner 8 has a cleaner blade 8*a* which cleans the peripheral face of the photosensitive drum 7, and the peripheral face thereof is initialized and electrified uniformly by the electrifying roller 9. As the peripheral face of the photosensitive drum 7 is subjected to exposure by the optical writing head 11 in accordance with an image signal supplied from a control unit, an electrostatic latent image having a high-voltage part by the initialization electrifying and a low-voltage part attenuated by exposure is formed on the peripheral face of the photosensitive drum 7.

The electrostatic latent image is moved to a developing position formed by a part where the photosensitive drum 7 and the developing roller 13 face with each other together with a rotation of the photosensitive drum 7 in the clockwise direction indicated by an arrow.

The developing unit 37 always retains toner supplied from the toner cartridge 35 located thereabove. The stirrer 42 stirs the toner so that the toner does not become solidified, and the supply roller 19 supplies the toner on the peripheral face of the developing roller 13 while rotating in the same direction as that of the developing roller 13 as indicated by an arrow.

The toner supplied on the peripheral face of the developing roller 13 is regulated so as to be a certain thickness by the doctor blade 41 arranged at the downstream side of the conveyance direction (rotating direction) of the developing roller 13, and is rotatingly conveyed to the developing position.

The toner rotatingly conveyed to the developing position is transferred to the low-voltage part of the electrostatic latent image by electric potential difference between the developing roller 13 and the peripheral face of the photosensitive drum 7, so that the low-voltage part of the electrostatic latent image is visualized by the toner, thereby developing a toner image on the peripheral face of the photosensitive drum 7.

The toner image developed on the peripheral face of the photosensitive drum 7 is rotatingly conveyed to a transfer part where the primary transfer roller 18 and the photosensitive drum 7 face with each other by the intermediate transfer belt 14, and is transferred on the intermediate transfer belt 14 by electrical charges with an opposite polarity to that of the low-voltage part of the electrostatic latent image and applied from the primary transfer roller 18 to the intermediate transfer belt 14.

Note that the cleaner 8 scrapes out toner remaining on the peripheral face of the photosensitive drum 7 by the cleaner blade 8*a* after the toner image is transferred on the intermediate transfer belt 14 to uniformly clean the peripheral face of the photosensitive drum 7 before it is initialized and electrified.

The toner image transferred on the intermediate transfer belt 14 is conveyed to the secondary transfer part where the driven roller 16 shown in FIG. 1 and the secondary transfer roller 26 face with each other, and is transferred on a transfer material (paper) fed from the paper feeding cassette 21 of the paper feeder 4 to the secondary transfer part.

Thereafter, the transferred toner image is fixed on a face of the paper by the belt-type fixing device 27, and the paper on which the toner image is fixed is ejected on the ejected paper tray 29 through the carry-out roller pair 28, and the paper ejecting roller pair 31.

Figure 14A:
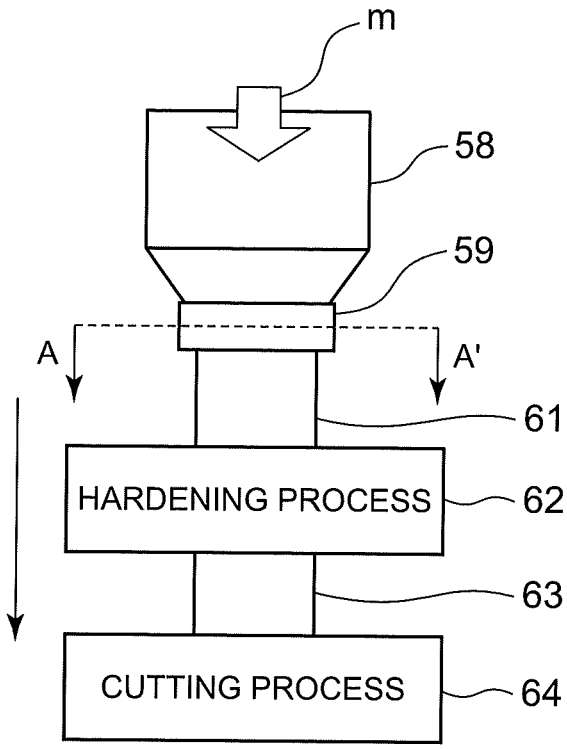
FIG. 14A (PRIOR ART)
FIG. 14A to 14C are exemplary diagrams showing a tube-like pulling scheme production process as an example of a conventional technique of producing an endless belt which will be an intermediate transfer belt.
Figure 14B:
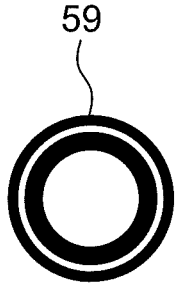
FIG. 14B (PRIOR ART)
Figure 14C:
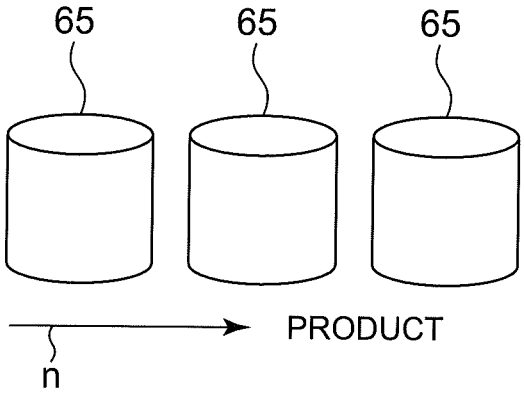
FIG. 14C (PRIOR ART)

FIGS. 14A to 14C are diagrams for explaining an example of a conventional technique of producing an endless belt which will be the intermediate transfer belt 14 used for the printer 1.

FIG. 14A is an exemplary diagram showing a tube-like pulling scheme endless belt production process as an example. FIG. 14B is a cross-sectional view along a line A-A' in FIG. 14A. FIG. 14C shows a final product.

According to the tube-like pulling scheme production technique, first, a thermoplastic belt material resin prior to hardening is put in a material container 58 shown in FIG. 14A. Attached to a lower part of the material container 58 is an annular mold 59.

As is indicated by an arrow m, as pressure is applied from the above of the material container 58, a thermoplastic resin 61 prior to hardening is pushed out from the mold 59 in a tube-like manner. When the resin is processed through a hardening process 62 while being pulled out, the resin becomes a tube-like hardened resin 63 and is successively pulled out.

The tube-like hardened resin is cut to a predetermined length through a cutting process 64. The cut resin becomes an endless belt, and successively conveyed in a direction indicated by an arrow n on a conveyer belt, thereby finishing a final product which will be an intermediate transfer belt 65.

Figure 15A:
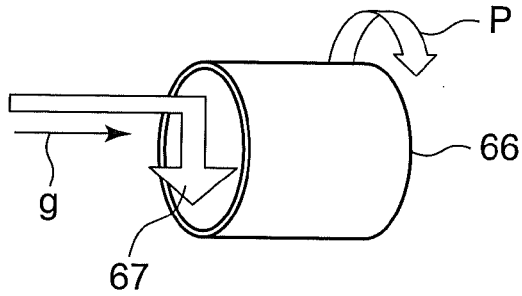
FIG. 15A (PRIOR ART)
FIG. 15A to 15C are exemplary diagrams showing a centrifugal-formation scheme production process as another example of the conventional technique of producing an endless belt which will be an intermediate transfer belt.
Figure 15B:
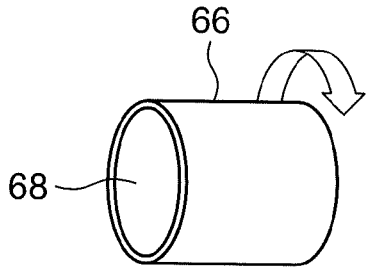
FIG. 15B (PRIOR ART)
Figure 15C:
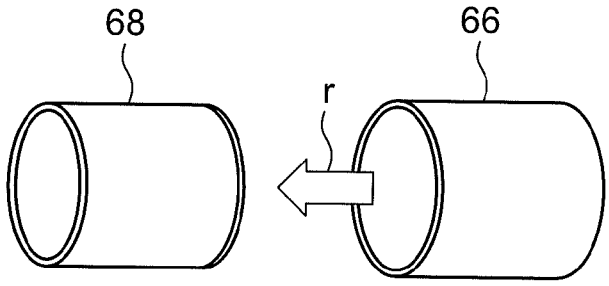
FIG. 15C (PRIOR ART)

Conversely, FIGS. 15A to 15C are exemplary diagrams showing an example of a centrifugal-formation scheme endless belt producing process which is another conventional technique of producing an endless belt that will be an intermediate transfer belt. According to the centrifugal-formation scheme production process, as shown in FIG. 15A, a cylindrical mold 66 is rotating in a direction indicated by an arrow p.

A thermoplastic belt material resin prior to hardening is applied on the internal face of the rotating mold 66. Regarding how to apply the resin, the thermoplastic belt material resin prior to hardening is dropped from a droplet nozzle 67 with the droplet nozzle 67 being inserted in the mold 66 as indicated by an arrow g.

The dropped thermoplastic belt material resin prior to hardening is uniformly spread on the internal face of the mold 66 by centrifugal force as shown in FIG. 15B, and as a result, a tube-like film 68 having a predetermined thickness is formed.

Thereafter, the tube-like film 68 is hardened. The hardened tube-like film 68 is peeled out from the internal face of the mold 66, and as is indicated by an arrow r in FIG. 15C, the tube-like film 68 is taken out from the mold 66. Accordingly, a final product which is the tube-like film 68 that will be an intermediate transfer belt is produced.

Meanwhile, it has been explained that, when the above-explained intermediate transfer belt is embedded in the printer 1 and a strip-shaped long and thin image printed in parallel with the belt conveyance direction is primary transferred, a failure so-called "character missing" that only middle part of the long and thin image is not transferred and remains at the photosensitive drum side and only two parallel lines are transferred occurs often.

Figure 3A:
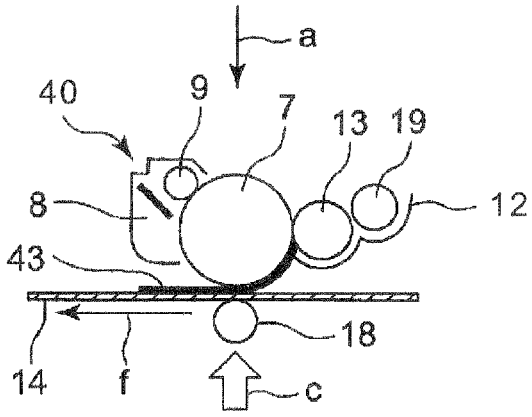
FIG. 3A to 3D are diagrams for explaining the reason why any character missing occurs in primary transfer.

FIGS. 3A to 3D are diagrams for explaining the reason why character missing occurs in primary transfer. FIG. 3A is an exemplary side view showing how a toner image 43 (an image of line parallel to the sub-scanning direction of the photosensitive drum 7) is transferred on the intermediate transfer belt 14 in primary transfer at a part where the photosensitive drum 7 and the primary transfer roller 18 face with each other.

Figure 3B:
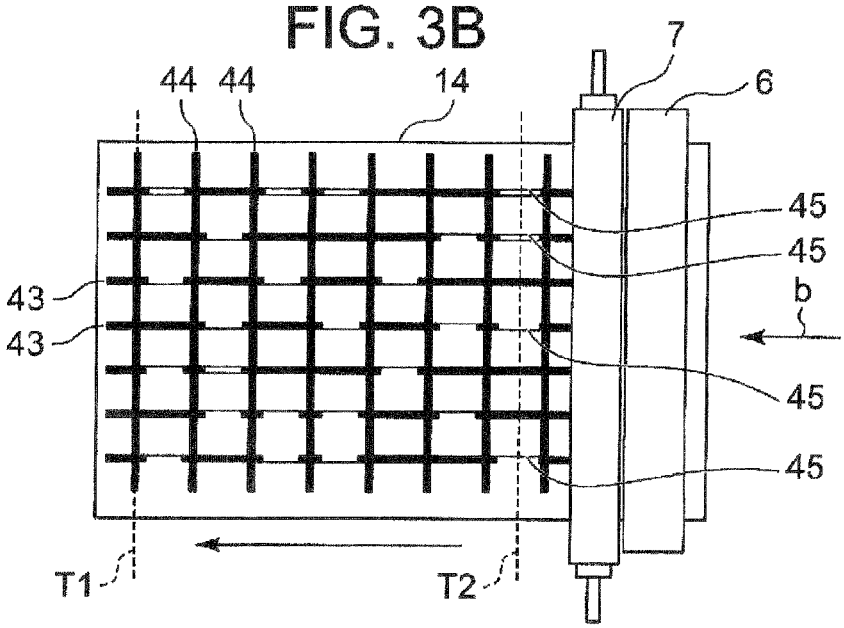

Note that the same structural element as that of FIG. 2 in FIGS. 3A to 3D is denoted by the same reference numeral. FIG. 3B is a diagram of FIG. 3A as viewed in a direction of an arrow a, and shows illustrative toner image (43, 44) having thin strip-shaped lines forming a vertical and horizontal lattice pattern across the whole print area. The toner image 44 is an image of a line that is parrellel to the main scanning direction of the photosensitive drum 7.

Figure 3C:
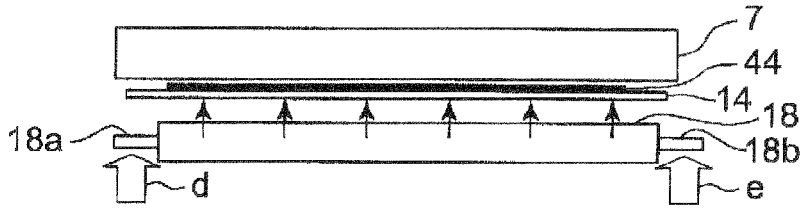
Figure 3D:
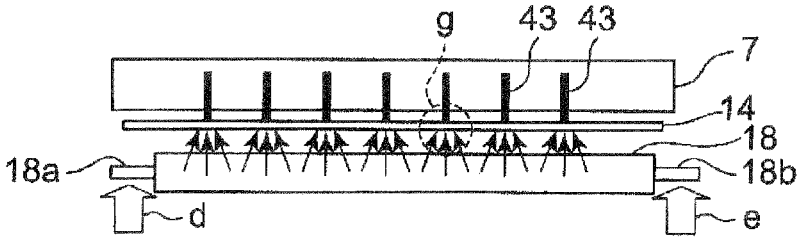

FIG. 3C shows a condition in which a part indicated by a dashed line T1 (line image parallel to the main scanning direction of the lattice pattern) in the horizontal and vertical lattice pattern in FIG. 3B is being transferred at the primary transfer part where the photosensitive drum 7 and the primary transfer roller 18 face with each other. FIG. 3D is a diagram showing a condition in which a part indicated by a dashed line T2 (line image parallel to the sub-scanning direction of the lattice pattern) in FIG. 3B is being transferred at the primary transfer part The lattice pattern toner image shown in FIG. 3B has character missing 45 in four line images 43 among seven line images 43 parallel to the sub-scanning line.

In general, when a roller is used for primary transfer, in order to ensure a transfer nip width on some level at the part where the photosensitive drum 7 and the primary transfer roller 18 face with each other and to ensure a driven property relative to the intermediate transfer belt 14 so as to improve the transfer characteristic, it is typical that the primary transfer roller 18 is formed of an elastic body, such as a foamed body or a rubber.

That is, the primary transfer roller 18 itself has no driving mechanism, but has a rotating shaft with both ends 18*a*, 18*b* thereof shown in FIGS. 3C and 3D being supported by a non-illustrated support member, and is urged toward the photosensitive drum 7 via the intermediate transfer belt 14 as is indicated by arrows c, d, and e in FIGS. 3A, 3C and 3D, respectively.

Accordingly, the primary transfer roller 18 abuts the intermediate transfer belt 14 held at the facing part with the photosensitive drum 7, and followingly actuates with the intermediate transfer belt 14 which circulatingly moves in the direction of an arrow f in FIG. 3A.

In primary transfer, as shown in FIG. 3D, the toner image 43 which is parallel lines to the rotating direction (the driving direction of the intermediate transfer belt 14) of the photosensitive drum 7 is developed on the photosensitive drum 7, and is primary transferred on the intermediate transfer belt 14.

Figure 4A:
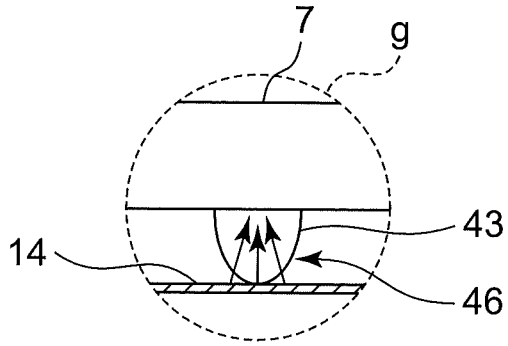
FIG. 4A is an exemplary diagram showing force applied to a strip-shaped toner image in primary transfer.
Figure 4B:
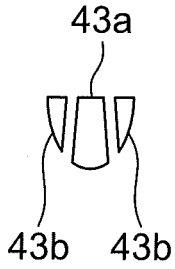
FIG. 4B is an exemplary diagram showing a state where significant shape change occurred at the side of the strip-shaped toner image and the center thereof in occurrence of character missing.
Figure 4C:
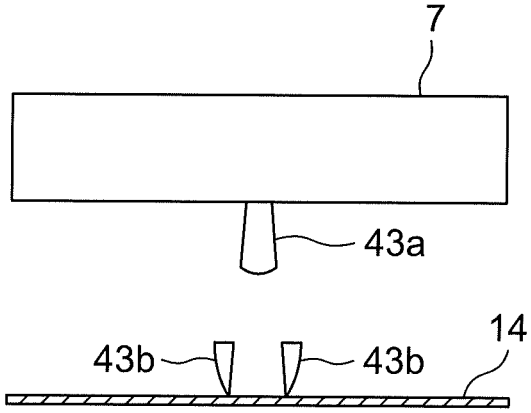
FIG. 4C is an exemplary diagram showing a condition in which character missing occurs resulting from FIG. 4B.

FIG. 4A is an enlarged view of a part surrounded by a dashed line g in FIG. 3D. FIG. 4B is an exemplary diagram showing the state where significant shape change occurs at the side of the toner image of the line image and the center thereof in occurrence of character missing. FIG. 4C is an exemplary diagram showing a condition in which character missing occurs as a result from FIG. 4B.

When primary transfer is performed, as shown in FIG. 4A, a toner image forming the line image 43 with an mountain shape at the center thereof on the photosensitive drum 7 is held between the photosensitive drum 7 and the intermediate transfer belt 14, and as shown in FIGS. 3A, 3D, is pushed against the photosensitive drum 7 from the intermediate transfer belt 14 by the primary transfer roller 18.

Pressing force acts on the toner image 43 forming the line image with the mountain shape at the center thereof toward the photosensitive drum 7 from the external side of the mountain shape to the center which is indicated by three arrows 46 in FIG. 4A. That is, the bottom of the mountain shape of the toner image 43 (the face closely contacting the face of the photosensitive drum 7) has the center part most strongly pressed against the face of the photosensitive drum 7.

In this fashion, as pressure is concentrated to the center part of the toner image 43, condensation of toner occurs inside the toner image 43 due to compression, and a significant shape change occurs between the end of the image and the center thereof.

As shown in FIG. 4B, a toner mass 43*a* of the central part where pressure is intensively concentrated is released from electrostatic force, and as shown in FIG. 4C, is not transferred and remains on the photosensitive drum 7 while being condensed, and only side toner masses 43*b* are transferred to the intermediate transfer belt. In this fashion, only both side parts of a line image are transferred, and a character-missing image like two lines is thus generated.

Accordingly, the inventor of the present invention focused on changing the surface characteristic of the intermediate transfer belt in order to overcome a character-missing image. Hence, the inventor of the present invention checked a relationship between surface roughness of an intermediate transfer belt and how pressure is applied to a toner image or condensation thereof.

First, four kinds of intermediate transfer belts produced through the technique of FIG. 14 or FIG. 15 having different but similar surface roughness were taken as a first group, four kinds of intermediate transfer belt having surface roughness rougher than those of the first group and different from one another but similar to one another were taken as a second group, four kinds of intermediate transfer belts having surface roughness rougher than those of the second group and different from one another but similar to one another were taken as a third group, and so on, and a total of five groups, and 20 kinds of intermediate transfer belts were prepared.

FIGS. 5A to 5E are diagrams showing a condition in which each piece of each group among five groups of prepared intermediate transfer belts was representatively picked up and the surface roughness thereof was observed through a laser microscope.

Figure 5A:
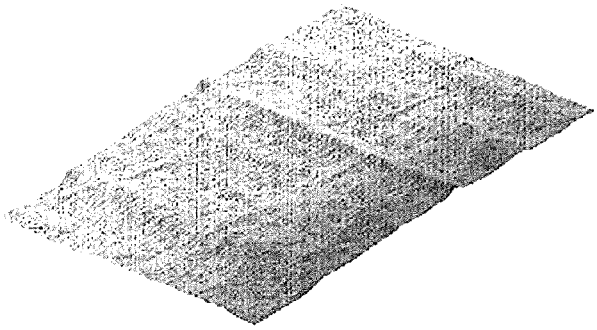
FIG. 5A to 5E are diagrams showing a condition in which each piece among respective groups of intermediate transfer belts 5 produced through a conventional endless belt producing technique was representatively picked up and the surface roughness thereof was observed through a laser microscope.
Figure 5D:
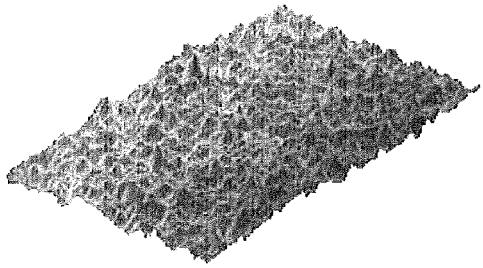
Figure 5B:
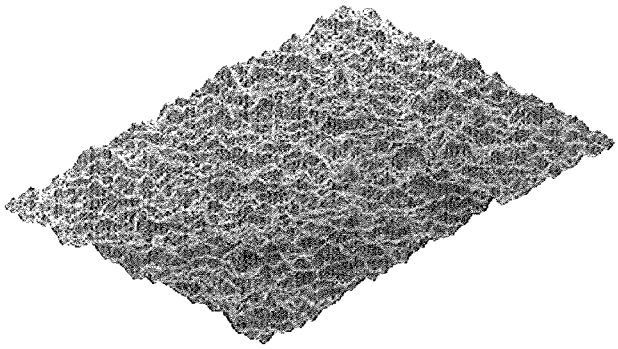

An intermediate transfer belt in the first group having the smallest surface roughness shown in FIG. 5A is called a "belt A", and an intermediate transfer belt in the second group having the next smallest surface roughness shown in FIG. 5B is called a "belt B".

Figure 5E:
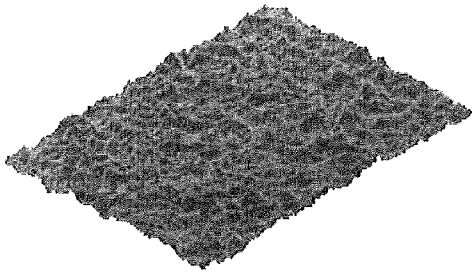
Figure 5C:
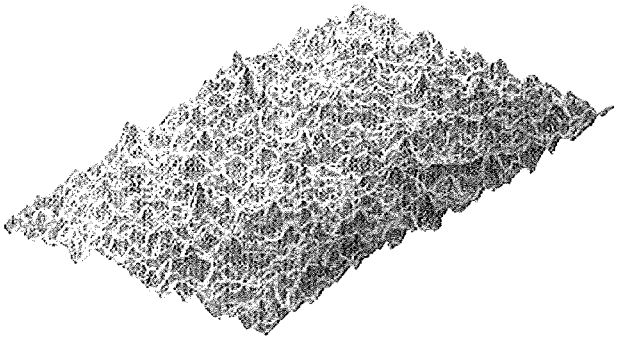

Furthermore, an intermediate transfer belt in the third group having the third smallest surface roughness shown in FIG. 5C is called a "belt C", and, the fourth group in FIG. 5D and the fifth group in FIG. 5E are called a "belt D", and a "belt E", respectively, in an order that the surface roughness becomes rougher.

Figures 6A, 6B:
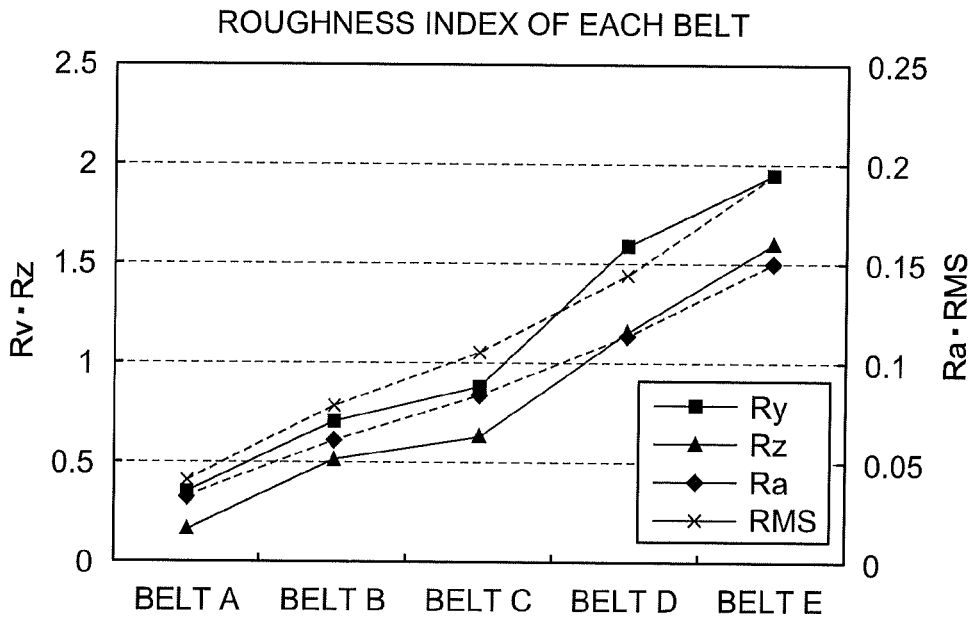
FIG. 6A is a table showing measured values Ra, Ry, Rz, and RMS of respective surface roughness of belts A, B, C, D, and E.
FIG. 6B is a diagram showing respective surface roughness indexes of the belts A, B, C, D, and E.

FIG. 6A is a table showing Ra, Ry, Rz, and RMS which are respective surface roughness values when respective surface roughness of the belts A, B, C, D, and E were measured. FIG. 6B is a diagram showing respective surface roughness indexes of the belts A, B, C, D, and E.

Note that a color laser microscope VK8550 made by KEYENCE Corporation was used for measurement of the surface roughness. The lens magnification ratio was ×100, the unit was μm, and a measured area was 12000 $\mu m^2$.

In the diagram of FIG. 6B showing respective surface roughness indexes, the horizontal line represents the belts A, B, C, D, and E, in this order, a left vertical axis represents roughness indexes Ry, Rz, and a right vertical axis represents roughness indexes Ra, RMS.

Figure 7A:
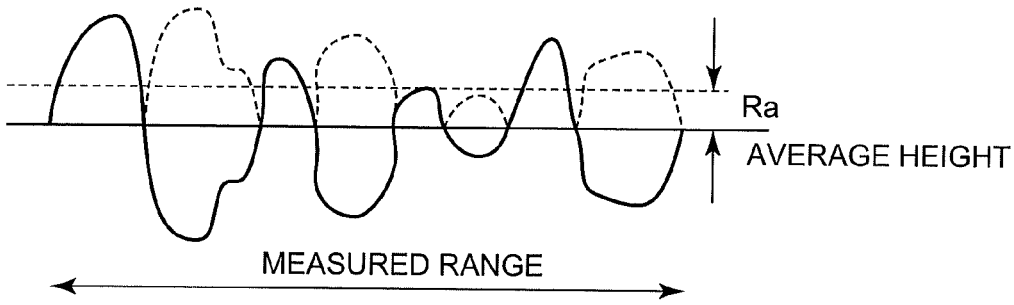
FIG. 7A is a diagram showing how to calculate Ra which represents a quality of surface roughness.
Figure 7B:
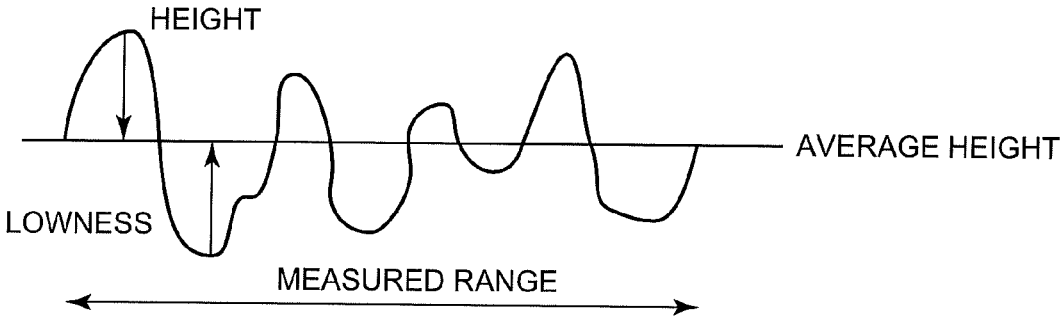
FIG. 7B is a diagram showing how to calculate Rz which represents an actual measure of surface roughness.

FIG. 7A is a diagram showing how to calculate Ra which represents a quality of surface roughness, and FIG. 7B is a diagram showing how to calculate Rz which represents an actual measure of surface roughness. Ra represents an arithmetic surface roughness which is an amplitude average parameter in the height (roughness) direction in a measured range. That is, Ra is expressed by an average distance of concavity and convexity from an average height.

In contrast, Rz represents an average roughness out of 10 points, and is expressed by a sum of an average up to five point from the highest height (angle direction) from an average height in the measured range and an average up to five point from the largest lowness (counter direction) from an average height. That is, it is calculated from an equation "Rz=((height 1+ . . . +height 5)+(lowness 1+ . . . +lowness 5))/5".

From such a relationship between the surface characteristic of the intermediate transfer belt and a condition of character missing, it is verified that a condition of character missing was improved as the surface roughness was made rougher from the belt A to the belt E.

Figure 8A:
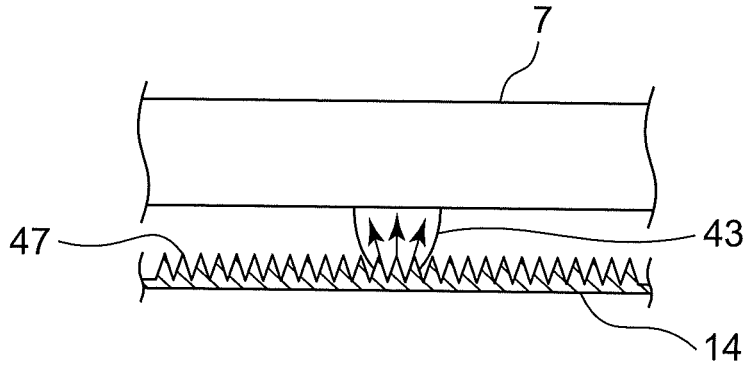
FIGS. 8A and 8B are diagrams for explaining the reason why character missing is improved.
Figure 8B:
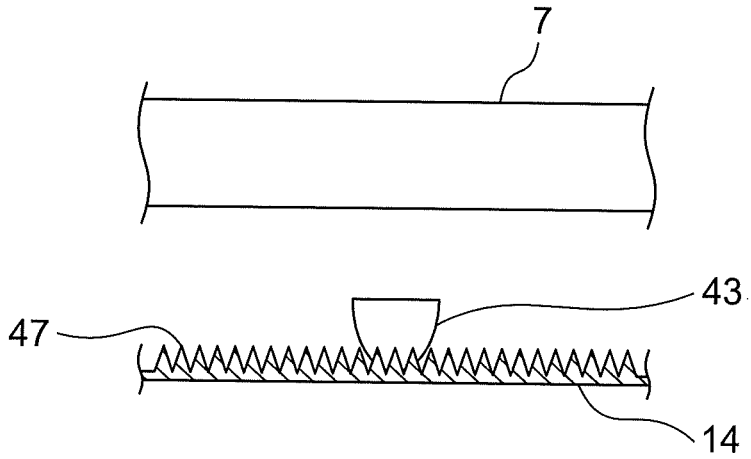

FIGS. 8A and 8B are diagrams for explaining the reason why a condition of character missing is improved. It is thought that a following reason improves character missing as the surface roughness of a belt becomes rougher. That is, as shown in FIG. 4A, it is thought that when condensation of toner is about to occur due to depressing by the intermediate transfer belt 14 and the photosensitive drum 7, as shown in FIG. 8A, a convex part 47 of the concavity and convexity of the belt surface enters into the toner mass 43, and suppresses any condensation action of toner, so that as shown in FIG. 8B, any character missing is suppressed.

Regarding checking of a character-missing condition of transferred toner relative to five kinds of intermediate transfer belts including the belts A, B, C, D, and E in the foregoing five groups, there are several kinds of toners, so that it is necessary to check a relationship between the condensation property of individual kind of toner and character missing.

In general, a flowability test is for acquiring a property value for explaining toner condensation, and a three-stage-screen vibrating/falling test is appropriate for the toner flowability test. Therefore, in the present example, a micro electromagnetic vibrating screen apparatus type M-2 made by TSUTSUI Scientific Instruments Co., Ltd., was used for the three-stage-screen vibrating/falling test.

The micro electromagnetic vibrating screen apparatus type M-2 allows a certain amount of toner to be put in an upper screen, vibrates screens of three stages with vibration of a regulated certain period, and defines a flowability index from an amount of toner remained on each screen.

FIG. 9A is an exemplary diagram showing three-stage-screen vibrating/falling test apparatus (micro electromagnetic vibrating screen apparatus type M-2 made by TSUTSUI Scientific Instruments Co., Ltd.) which carried out a toner flowability test, and FIGS. 9B to 9D are diagrams showing results of three-stage-screen vibrating/falling test for three kinds of toners and respective flowability indexes.

In a three-stage-screen vibrating/falling test apparatus 48 shown in FIG. 9A, an upper screen 49 had a mesh of 500 μm, a middle screen 51 had a mesh of 250 μm, and a lower screen had a mesh of 106 μm. In the test, a test object toner was put in the upper screen 49, and the three-stage-screen vibrating/falling test apparatus 48 vibrated in a horizontal direction as indicated by an arrow h in the horizontal direction.

In the present example, three kinds of toners A, B, and C were prepared, and 5 g of each toner was put in the upper screen 49 and vibrated for 45 seconds for each test. Fine toner put in the upper screen 49 successively passed through the upper, middle and lower screens, and dropped in a tray 53 located at the lowermost position.

FIGS. 9B to 9D show respective toner amounts remained on the upper, middle and lower screens (upper screen 49, middle screen 51, and lower screen 52) and on the tray 53 for each of the three kinds of toners in a unit of gram, and a coefficient and a flowability are shown below each toner amount.

According to this technique, a flowability of toner can be quantified between a lower limit value 2 (flowability: small) and a value 10 which is an upper limit (flowability: large). That is, a flowability index can be acquired from an equation "flowability index=(upper screen flowability+middle screen flowability+lower screen flowability)" described below respective tables in FIGS. 9B to 9D.

Regarding the toner A shown in FIG. 9B, the flowability was good, and the flowability index was 8.03. Regarding the toner B shown in FIG. 9C, the flowability was poor and the flowability index was 3.26. Regarding the toner C shown in FIG. 9D, the flowability was confirmed and the flowability index was 6.73.

FIG. 10 is a diagram showing respective evaluations for character missing determined for combinations of belt surface roughness of the belt A, B, C, and D and toner flowabilities of the toners A, B, and C in a primary transfer test.

In the character missing evaluation, no missing was expressed by a double circle mark, a microscopical missing was expressed by a circle mark, an unnoticeable missing was expressed by a black circle mark, a slightly-noticeable missing was expressed by a triangle mark, and almost-complete missing was expressed by a cross mark. That is, in FIG. 10, a combination indicated by hatching is a combination which can be determined as preferable.

From those evaluation results and surface roughness data of belts A to E, it is checked that at least the belt surface roughness relates to character missing Like the belts B to E, if the belt surface roughness is Ra≧0.05 μm and Rz≧0.5 μm, even if toner having poor flowability is used, it is verified that any character missing can be suppressed without any practical problem.

Therefore, it can be concluded that it is appropriate if an intermediate transfer belt having a preferable predetermined belt surface roughness as explained above is selected and used for the printer 1. In order to do so, it is necessary in the endless belt production technique shown in FIG. 14 or FIG. 15 to make the surface of the mold rough beforehand in a belt producing machine so as to enable production of an intermediate transfer belt having a predetermined belt surface roughness or to carry out a process of directly making the belt surface rough after the endless belt production process so as to produce an intermediate transfer belt having a predetermined belt surface roughness.

In general, in order to cause a surface of an object to have a predetermined roughness, a rotating body having a surface with specified surface roughness is pressed against the surface of a process object by a certain pressure, and the rotating body and the process object are relatively moved in a certain direction to carry out surface roughening.

As a result, the surface of the process object having undergone the process becomes to have a certain roughness. However, the surface also becomes to have a streak-like directional property (streak).

FIG. 11A is a diagram showing a case in which the streaks of surface roughness are parallel to the driving direction of the intermediate transfer belt, and FIG. 11B is a diagram showing a measured angle of linear roughness relative to such streaks. FIG. 11C is a table showing a measured result, and FIG. 11D is a graph of values in FIG. 11C.

Formed on a sample piece 56 of the intermediate transfer belt shown in FIG. 11A are streaks 57 of surface roughness parallel to the driving direction of the intermediate transfer belt. For the sample piece 56, linear roughness were measured with a measured angle relative to the streaks being set to 0 degree, 22.55 degree, 36.85 degree, 45 degree, and 90 degree as shown in FIG. 11B.

A correspondence relationship between a measured angle and a measured value is as shown in FIG. 11C. FIG. 11D is a graph of results shown in FIG. 11C. In FIG. 11D, the horizontal axis represents a measured angle (degree) and the vertical axis represents roughness (μm).

In FIG. 11D, Ra, Ry, and Rz among the values shown in FIG. 11C are picked up, Ra is indicated by a plot of white squares, Ry is indicated by a plot of white rhomboids, and Rz is indicated by white triangles.

As is indicated in FIG. 11D, when the measured angle of linear roughness shown in FIG. 11B relative to streak-like surface roughness (streaks 57 of surface roughness parallel to the driving direction of the intermediate transfer belt in the sample 56) is from 0 to 40 degree, the change in a value is large, but when it exceeds 40 degree, a value becomes stable and is substantially constant up to 90 degree.

Paying attention to individual values for each roughness index, Ra indicated by the white square plot becomes stable at a value equal to 0.1 μm or larger, and is comparable with the value of Ra of the belt C shown in FIG. 6B with a circular evaluation mark. Moreover, Rz indicated by the white triangle plot becomes stable at a value equal to 0.55 μm or larger, and largely exceeds the value of Rz of the belt B shown in FIG. 6B with a triangular evaluation mark. Furthermore, Ry indicated by the white rhomboid plot becomes stable at a value equal to 0.75 μm or larger, and largely exceeds the value of Ry of the belt B shown in FIG. 6B with a triangular evaluation mark.

Through these observation, it becomes clear that a good primary transfer image can be formed without deteriorating a roughness component which suppresses any character missing if an angle relative to the driving direction of the intermediate transfer belt is within a range from 40 to 90 degree (from 40 to 140 degree including a rotation in a negative direction).

Meanwhile, it is general that the intermediate transfer belt performs primary transfer through a cleaning process before the primary transfer is performed, and a blade cleaning technique of causing a blade to contact the intermediate transfer belt to clean it in the cleaning process is general and inexpensive. In this case, when blade cleaning is performed on the surface of the intermediate transfer belt having surface roughness with streaks, if the streaks are parallel to the conveyance direction of the intermediate transfer belt, streak-like protrusions forming streaks always contact the same portion of the leading end of the blade, so that partial load applied to the blade becomes large.

In this point, if the angle of the streaks is within a range from 40 to 140 degree like the present invention, contact points to the blade by the streaks minutely move and change, so that the blade is not damaged, and can be maintained in a good condition for a long time.

Figure 12A:
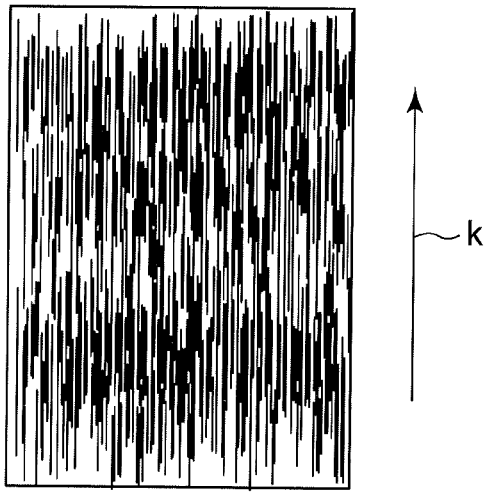
FIG. 12A to 12D are exemplary diagrams for reference specifically showing streaks when the angle thereof relative to the driving direction of the intermediate transfer belt is 0 degree.

FIGS. 12A to 12D are exemplary diagrams for reference specifically showing streaks having an angle of 0, 40, 90, and 140 degree relative to the driving direction of the intermediate transfer belt respectively indicated by an arrow k. Note that the streaks with an angle of 0 degree shown in FIG. 12A is most likely to cause a character missing failure.

Figure 12B:
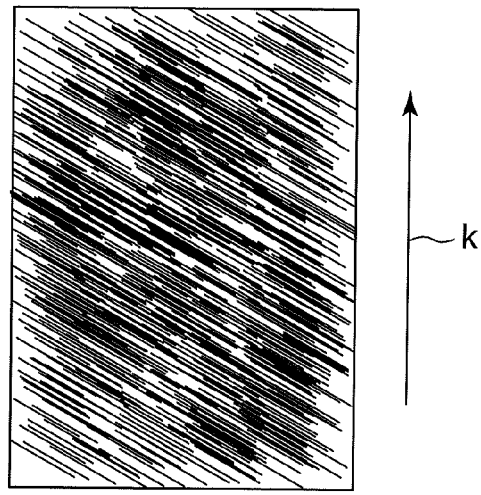
Figure 12C:
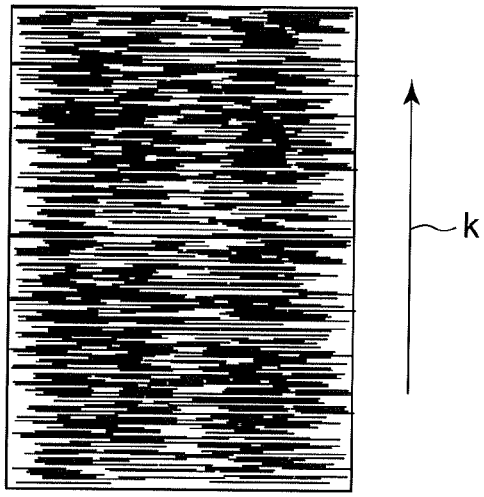
Figure 12D:
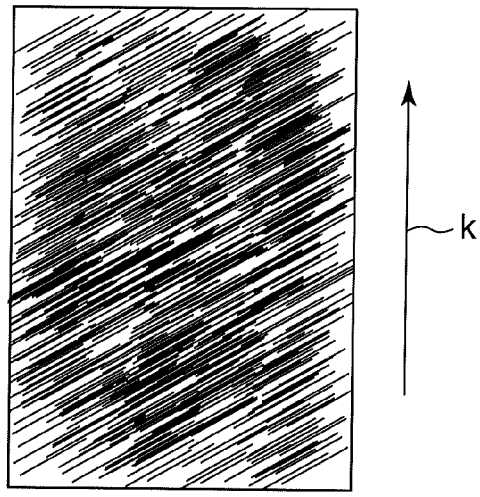

Streaks from the angle of 40 degree shown in FIG. 12B to the angle of 140 degree shown in FIG. 12D are not likely to cause character missing. The streaks with an angle of 90 degree of FIG. 12C are intermediate streaks when successively changed from FIG. 12B to FIG. 12D in this order.

Based on those results, if, for example, random streaks (mixed streaks with different directionalities) are added, it is possible to realize an intermediate transfer belt which has the surface condition similar to a normal mat-like condition and which can overcome an adverse effect of character missing originating from the directionalities of streaks.

Figure 13A:
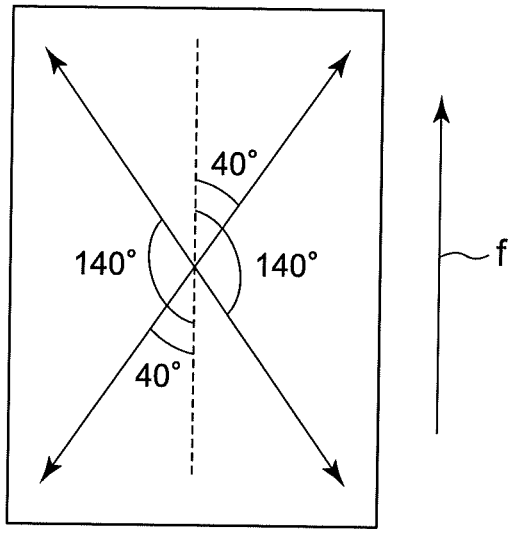
FIG. 13A is a diagram showing a range of an angle from 40 to 140 degree relative to the driving direction of the intermediate transfer belt.
Figure 13B:
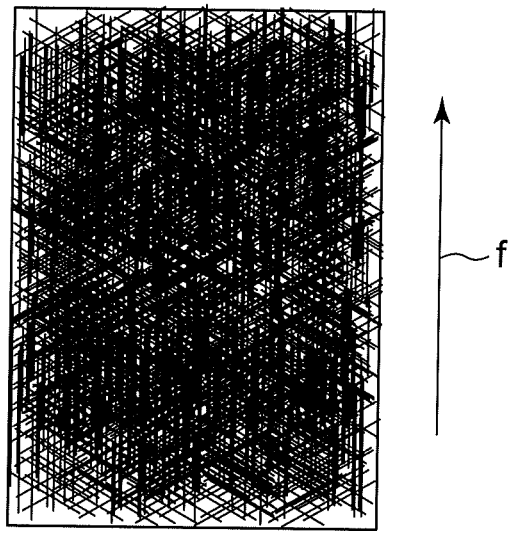
FIG. 13B is an exemplary diagram showing a belt surface having plural kinds of streaks with different angles from 40 to 140 degree mixed.

FIG. 13A is a diagram showing a range of an angle relative to the driving direction of the intermediate transfer belt indicated by an arrow f between 40 to 140 degree. FIG. 13B is an exemplary diagram showing a belt surface having roughness that plural streaks with different angles are mixed and formed at angles within the range from 40 to 140 degree. It is needless to say that such configuration can effectively act on suppression of any character missing.

Note that a process of causing the belt surface to have such roughness that plural streaks with different angles shown in FIGS. 12B to 12D or FIG. 13B mixed and formed on the belt surface can be realized by performing plural number of processing using a rotating body having predetermined surface roughness on the surface thereof while changing a line angle of the contact face of the rotating body with the surface of a process object.

The technique of performing surface roughening on the surface of the process object using the rotating body having the predetermined surface roughness is inexpensive and highly versatile in comparison with surface roughening of causing the surface of an object to be a mat-like condition with fine concavity and convexity.

As explained above, it was conventionally thought that balancing of a factor which causes character missing and a factor which does not cause any character missing is difficult because streak-like roughness has directionality, but according to the present embodiment, as the direction of streaks relative to the driving direction of the intermediate transfer belt is set within a range from 40 to 140 degree, it becomes possible to acquire a good and stable image without any character missing. Moreover, the cleaning characteristic becomes stable, so that it becomes possible to provide the intermediate transfer belt with good mass productivity.

It becomes clear from the result of a test that the intermediate transfer belt of the present embodiment can suppress any character missing with general conventional toner other than the toners of the foregoing example, and can acquire a good primary transfer image with uniformity. Therefore, it is possible to provide an intermediate transfer belt which is highly versatile and inexpensive.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

What is claimed is:

1. An intermediate transfer belt which is built in an electrophotographic image forming apparatus, on which a toner image formed on a photosensitive element is primary transferred, and which secondary transfers, at a secondary transfer unit, the primary-transferred toner image on a recording medium being conveyed, wherein plural streaks are formed by surface roughening on a surface of the intermediate transfer belt, wherein the plural streaks (i) each have a different angle relative to a driving direction of the intermediate transfer belt within a range from 40 to 140 degrees, and (ii) coexist on the surface of the intermediate transfer belt, and wherein a roughness of the surface of the intermediate transfer belt is Ra≧0.05 μm and Rz 0.5≧μm.

2. An electro-photographic image forming apparatus at least comprising:

a photosensitive element;

a toner image forming unit that forms a toner image on the photosensitive element; and an intermediate transfer belt on which the toner image formed on the photosensitive element is primary transferred, and which secondary transfers, at a secondary transfer unit, the primary transferred tone image on a recording medium being conveyed, wherein the intermediate transfer belt has plural streaks formed by surface roughening on a surface of the intermediate transfer belt, wherein the plural streaks (i) each have a different angle relative to a driving direction of the intermediate transfer belt within a range from 40 to 140 degrees, and (ii) coexist on the surface of the intermediate transfer belt, and wherein a roughness of the surface of the intermediate transfer belt is Ra≧0.05 μm and Rz≧0.5 μm.

* * * * *